US011440781B2

(12) United States Patent
Iotti

(10) Patent No.: US 11,440,781 B2
(45) Date of Patent: Sep. 13, 2022

(54) APPARATUS

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 0 days.

(21) Appl. No.: 16/737,572

(22) Filed: Jan. 8, 2020

(65) Prior Publication Data

US 2020/0223677 A1 Jul. 16, 2020

(30) Foreign Application Priority Data

Jan. 15, 2019 (IT) ..... 102019000000607

(51) Int. Cl.
*B66F 9/12* (2006.01)

(52) U.S. Cl.
CPC ..... *B66F 9/12* (2013.01)

(58) Field of Classification Search
CPC .. B66F 9/12; B66F 9/142; B66F 9/144; B66F 9/065
See application file for complete search history.

(56) References Cited

U.S. PATENT DOCUMENTS 3,024,933 A * 3/1962 Albert ..... B66F 9/065 414/705
3,075,665 A 1/1963 Repke
4,497,607 A 2/1985 Johannson
4,498,838 A * 2/1985 Johannson ..... B66F 9/16 414/664
4,688,982 A * 8/1987 Smart ..... B66F 9/065 414/667
4,699,560 A * 10/1987 Ostermeyer ..... B66F 9/065 414/696
6,056,503 A 5/2000 Way et al.
6,132,164 A * 10/2000 Way ..... B66F 9/0655 414/685
6,287,073 B1 * 9/2001 Lindgren ..... B66F 9/12 414/785
6,408,550 B1 * 6/2002 Allsopp ..... B66F 9/065 37/405
6,705,826 B1 * 3/2004 Callens ..... B66F 9/065 414/686
7,244,092 B1 * 7/2007 Darst ..... B66F 9/12 414/607
8,899,906 B2 * 12/2014 Peschel ..... B66F 9/142 414/667
8,944,218 B2 * 2/2015 Peschel ..... B66F 9/142 187/237
9,227,824 B2 * 1/2016 Philipopoulos ..... B66F 9/12
9,309,098 B2 * 4/2016 Lindenmuth ..... B66F 9/142
(Continued)

FOREIGN PATENT DOCUMENTS

WO 8303817 A1 11/1983

*Primary Examiner* — Kaitlin S Joerger
(74) *Attorney, Agent, or Firm* — Pearne & Gordon LLP

(57) ABSTRACT

Described is an apparatus (2) for a self-propelled operating machine (10) comprising a supporting frame (21, 22, 23) designed to be fastened at the rear to an attaching device wherein an operating arm (102) of the machine (10) is provided and designed to be coupled at the front to a tool (3). The frame includes two lateral uprights (21, 22) joined at the top by a transversal plate (23).

18 Claims, 6 Drawing Sheets

(56) References Cited

U.S. PATENT DOCUMENTS

| | | | | |
|---|---|---|---|---|
| 10,501,297 | B2 * | 12/2019 | Wright | B66F 9/144 |
| 10,759,641 | B1 * | 9/2020 | Whetstine | B66F 9/12 |
| 2004/0208736 | A1 * | 10/2004 | Mensch | B66F 9/144<br>414/685 |
| 2004/0240978 | A1 * | 12/2004 | Jowett | B66F 9/065<br>414/686 |
| 2010/0101895 | A1 * | 4/2010 | Collins | B66F 9/142<br>187/237 |
| 2010/0111647 | A1 * | 5/2010 | Noonan | B66F 9/18<br>414/24.5 |
| 2013/0092478 | A1 | 4/2013 | Peschel et al. | |
| 2015/0233084 | A1 * | 8/2015 | Seljestad | B66F 9/12<br>414/723 |
| 2015/0233085 | A1 * | 8/2015 | Seljestad | B66F 9/065<br>414/723 |
| 2015/0239718 | A1 * | 8/2015 | LaTendresse | B66F 9/065<br>414/728 |
| 2015/0251885 | A1 * | 9/2015 | Phillips, Sr. | B66F 9/144<br>414/667 |
| 2019/0039868 | A1 * | 2/2019 | Puszkiewicz | B66F 9/07513 |
| 2019/0202676 | A1 * | 7/2019 | Na | F15B 13/02 |

* cited by examiner

APPARATUS

This invention relates to improved apparatus designed to be used on self-propelled operating machines, in particular telescopic lifts or "telehandlers".

In particular, the invention may be an improved fork-carrier, with increased operational visibility.

Accessories are known in the prior art which are designed to be mounted on the telescopic operating arm of telehandlers in order to move loads.

Amongst the most common accessories there are forks, side transfer units, winches, jib arms, etc.

Various accessories comprise a supporting structure which is designed to attach in a removable fashion to a coupling device which is fitted to the operating arm is provided and which carries the tool which engages the load.

In particular, the accessory commonly known as "forks" or "fork" includes a structure or frame known in the jargon of the trade as "fork-carrier", to which the forks are coupled, that is to say, the tool equipped with prongs for inserting pallets or bales of hay or the like on forks.

More in detail, according to a prior art solution, the prongs of the fork are slidably mounted on a pin or central supporting element which is inserted in suitable lateral slots of the fork holder.

The prior art supporting frame T, which may also be sold separately, is rectangular and has a thick upper tubular crosspiece Q, for example with a quadrangular cross section, as shown in FIGS. 1 and 2.

The tubular crosspiece Q has a plurality of centring holes which allow, by means of suitable pins P, usually four in number, the prongs R to be locked correctly in position at their above-mentioned pin U, avoiding their sliding.

The prongs R may be tilted onto the forks T, in such a way as to reduce the overall size of the accessory during transport (see FIG. 6); for this reason, use is made of chains for securing the prongs and keeping them in the tilted configuration.

Although this solution is currently used in practice, it has some limitations which, in certain circumstances, make it difficult to use and which will be explained below with the aid of FIG. 3.

In order to be able to correctly insert forks in a load which is rested on the ground, the operator of the telehandler 10 needs to see how the tips of the prongs R of the forks are positioned relative to the load, so as to insert them in the correct manner in the base pallet.

However, the structure of the current fork-carriers T, with reference in particular to the above-mentioned upper crosspiece Q, creates at the ground, or in any case at the plane of the prongs R, non-visible intervals N1, N2 relative to the view point of the operator in the cabin, which occupy a significant area of the zone in front of the tips.

For this reason, currently, in order to be able to correctly pick up the load, the operator, after having moved the forks towards the load, might have to control the inclination of the forks in such a way as to make the tips visible, in order to have an idea of their relative position, and then redirect the forks and insert them in the pallet "blind", just using the approximate idea of the position of the tips which has been obtained before.

These manoeuvres are inconvenient and the need is therefore felt in the market for a telehandler apparatus with improved visibility which overcomes the limits of the prior art.

The technical purpose which forms the basis of the invention is to provide an improved apparatus which satisfies the above-mentioned need.

The specified aim is attained by the invention made according to claim 1.

Further features and advantages of the invention are more apparent in the non-limiting description of a preferred embodiment of the accessory which includes the apparatus, as illustrated in the accompanying drawings, in which.

Figure 2:
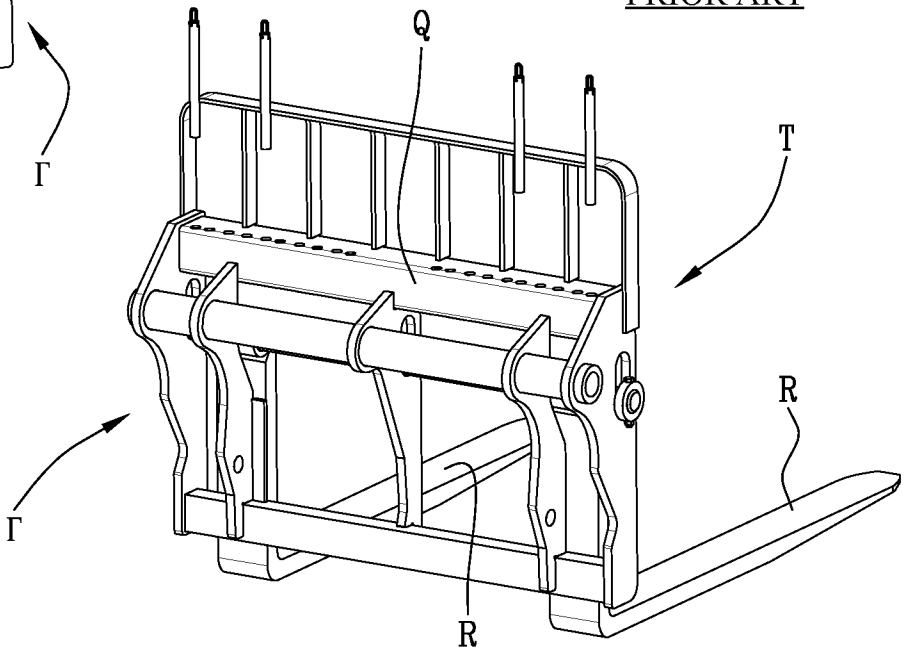
Fig.2 PRIOR ART
FIGS. 1 and 2 are axonometric views of the prior art apparatus.
Figure 1:
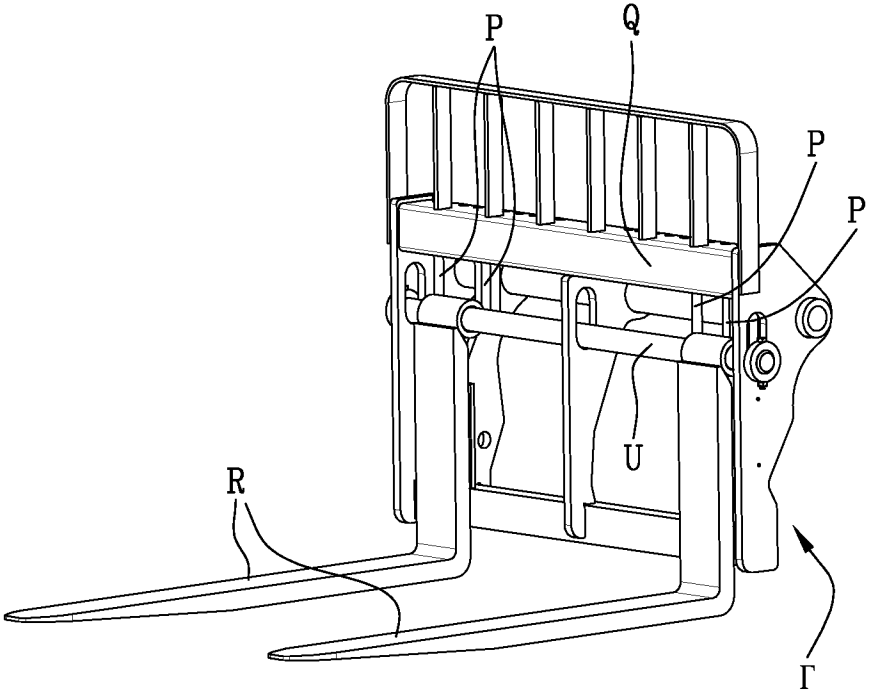
Fig.1 PRIOR ART

With reference to the accompanying drawings, the numeral 1 denotes in its entirety an accessory for self-propelled operating machines 10 which comprises an apparatus 2 according to the invention and a tool 3 carried by the apparatus.

More specifically, in the example shown, the apparatus 2 is an improved fork holder designed for use with a telehandler 10 and the tool is a fork for lifting loads, however, the inventive concept of the invention may also be incorporated in different apparatuses.

The apparatus 2 proposed comprises a supporting frame 21, 22, 23 preferably quadrangular in the shape of a frame, designed to be attached at the rear to a device 101 for connecting the operating arm 102 of the machine 10, for example by means of the rear tubular element labelled 24 in the drawings.

Moreover, the apparatus 2 is designed to be coupled at the front and to support the tool 3.

It should be noted that the expression "at the front" referred to the apparatus 2 refers to its side (or face) opposite the machine 10 and the arm 102, whilst the expression "at the rear" refers to the opposite side. According to an important aspect of the invention, the frame of the apparatus 2 includes two side uprights 21, 22, for example two plates, joined at the top by a transversal plate 23, instead of the tubular element of the prior art.

More specifically, the transversal plate 23 is inclined downwards in the front direction, preferably to form with the longitudinal axis of extension of the uprights 21, 22 a lower acute angle.

More in detail, if the tool 3 is a fork, the plate 23 which acts as an upper crosspiece lies in a plane which can define with the plane on which the prongs 31, 32 lie an angle of between 20 and 30 degrees and preferably between 22 and 24 degrees; still more preferably, the angle is substantially equal to 23 degrees.

Figure 4:
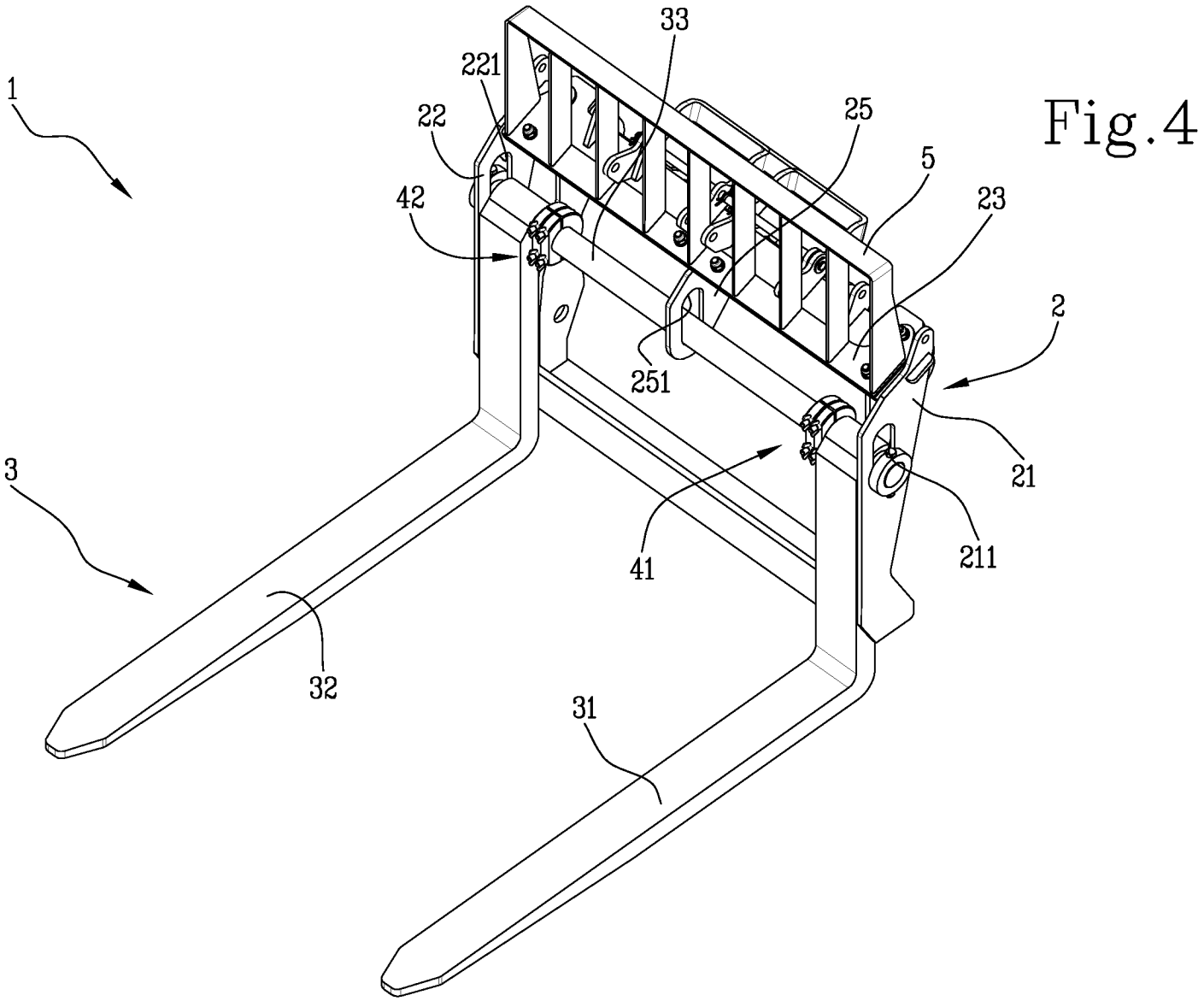
FIGS. 4 and 5 are perspective views of the apparatus according to the invention.
Figure 5:
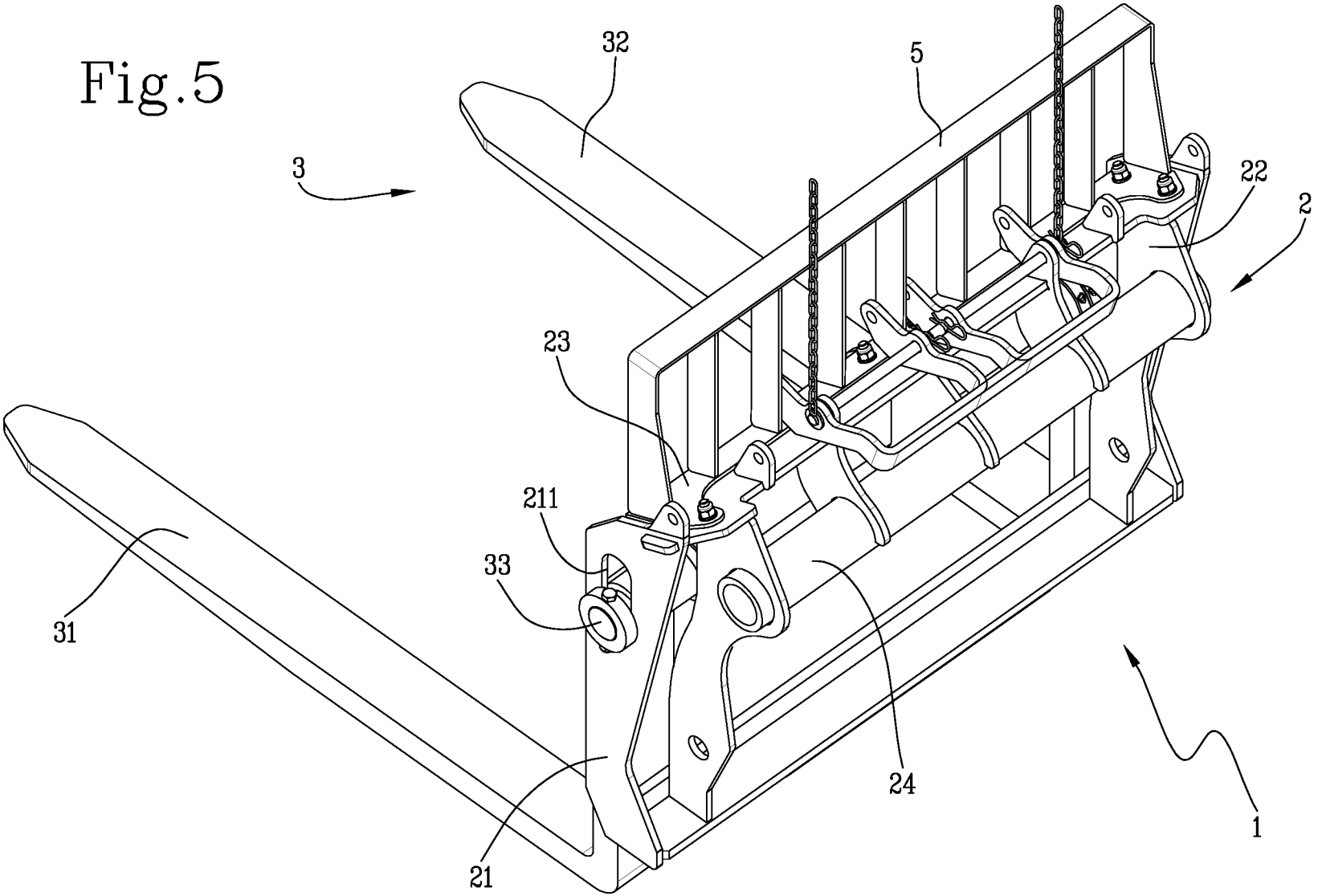

As mentioned above and as shown in FIGS. 4 and 5, the uprights 21, 22 may be two plates which are parallel to each other and are provided with a respective slot 211, 221 for simultaneously receiving an elongate supporting element 33 of the tool 3.

If the tool 3 is a fork, the supporting element 33 may be the tubular element, preferably circular, on which the prongs 31, 32 are mounted which, as explained in the description of the prior art, may be slidably associated with it.

Moreover, there may be a central plate 25 connected to the transversal plate 23 and perpendicular to it, which is also equipped with a slot 251 for receiving the supporting element of the tool 3.

Preferably, the invention includes two jaws 41, 42, which can be removably coupled to the supporting element, for example by using butterfly screws, for locking the tool 3 to the uprights 21, 22 of the apparatus 2.

In practice, the cylindrical ends of the prongs 31, 32, which are inserted on the supporting pin 33, are closed in a sandwich-like fashion between the jaws 41, 42 and the uprights 21, 22, which constitute two side walls; alternatively, the above-mentioned cylindrical ends may be closed between two jaws in any position along the pin 33.

The operation of the invention is explained below with reference to the accompanying drawings, by which a comparison may be made between the prior art and the invention.

Figure 8:
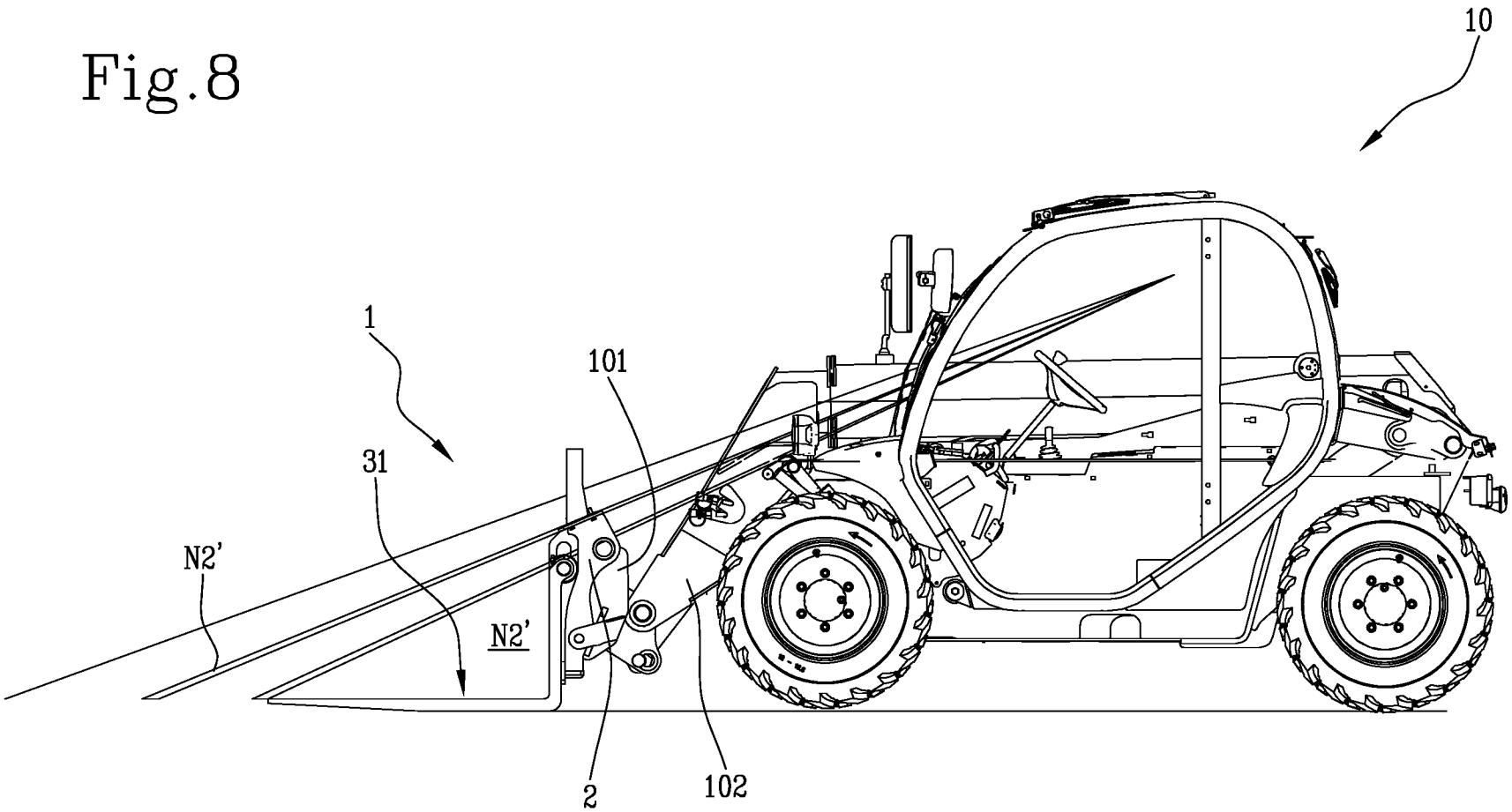
FIG. 8 is a side view of the proposed apparatus mounted on the operating arm of a telehandler.

The numerals N1' and N2' in FIG. 8 denote two non-visible intervals for the cabin operator in the case of use of the apparatus 2 according to the invention.

Figure 3:
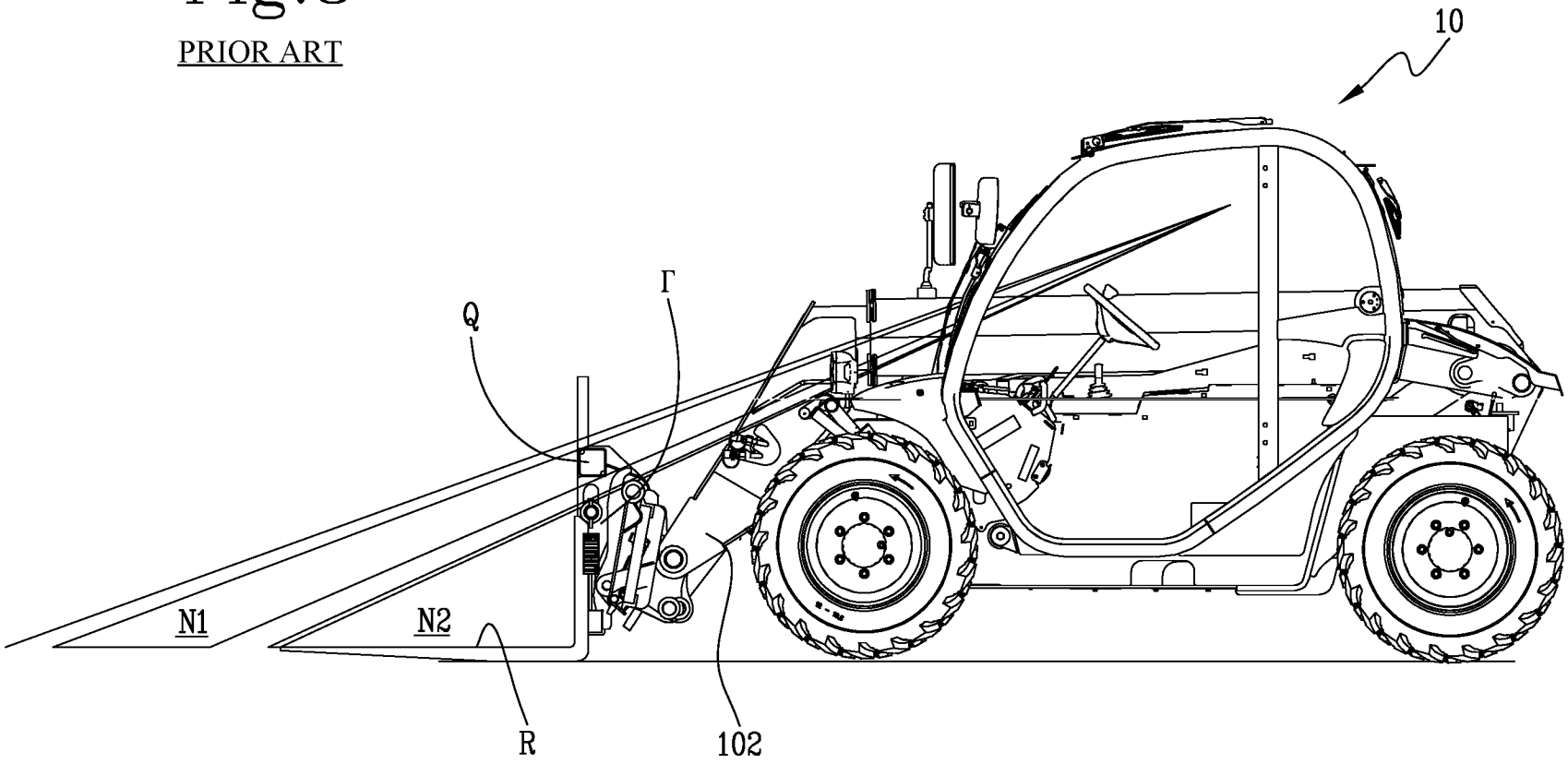
Fig.3 PRIOR ART
FIG. 3 is a side view of the prior art apparatus when it is attached to the operating arm of a telehandler.

From a comparison between FIGS. 3 and 8 it is immediately clear that the non-visible intervals N1', N2' of the apparatus 2 proposed, especially at or close to the tips of the prongs 31, 32 of the fork, are significantly reduced compared to those of the prior art equipment, with obvious advantages in terms of safety and ease of use.

In effect, thanks to the adoption of the upper crosspiece defined by the transversal plate 23, the view point of the operator who observes the load to be forked when it has carried the accessory in close proximity to it is far less obstructed than that of the traditional apparatuses.

In this way, it is possible to avoid the operator having to make those inconvenient and inefficient operations prior to the gripping of the load which were mentioned during the discussion of the prior art.

Further, having eliminated the tubular crosspiece and having implemented the configuration according to the invention, it is also possible to have a greater degree of tilting of the tool 3 on the apparatus 2, thereby obtaining a smaller overall size of the accessory 1 during road transport.

Figure 7:
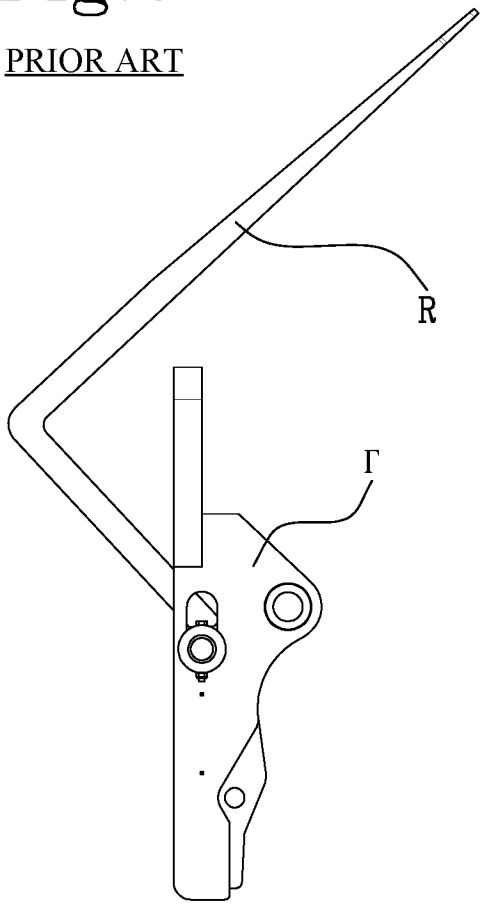
Fig.7 PRIOR ART
FIGS. 6 and 7 are side views of the apparatus according to the invention and of the prior art in the relative transport operating configurations.
Figure 6:
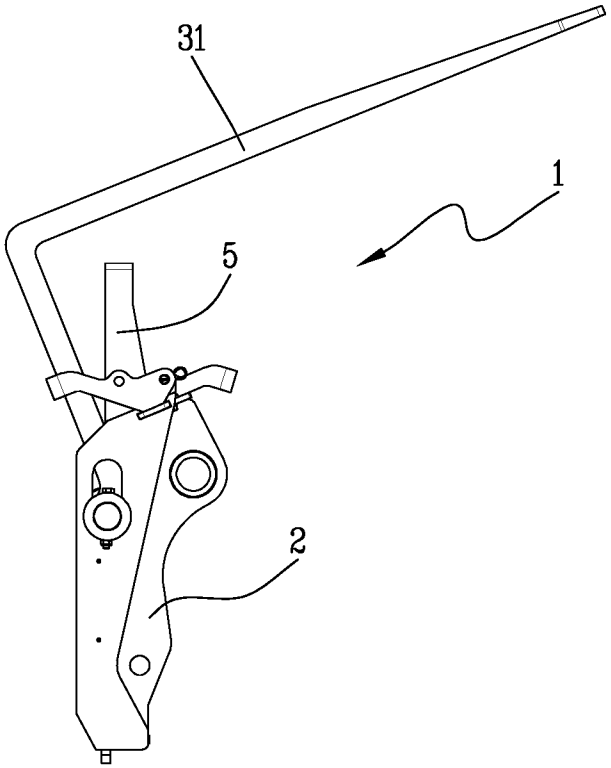

In effect, as can be seen by comparing FIGS. 6 and 7 it is clear that the invention allows the forks 3 to be tipped with a front angle between these and the apparatus 2 which is significantly greater than the tipping angle of the prior art.

It should also be noted that the fixing operation is safer because the barycentre of the forks 3 according to the invention is located in a position in which it tends to keep them in the tilted configuration.

In order to keep the prongs 31, 32 in the tilted position, suitable brackets are provided, which replace the prior art chains; the brackets, when not used, can simply be anchored to the rear of the apparatus 2, with obvious advantages in terms of convenience for the operator.

It should also be noted that having adopted the locking in position of the prongs 31, 32 to the tubular element for supporting the forks using jaws 41, 42 which can also be removed manually, especially if they are clamped using butterfly screws, it is much easier to fit and dismantle, but above all it allows the apparatus 2 to be fitted with tools even of different sizes and to better adjust the relative position in which they are to be applied to the apparatus 2.

Lastly, according to an advantageous preferred feature of the invention, the apparatus 2 is equipped with a load-supporting grid 5 which is removable, for example by means of bolts which join it to the transversal plate 23, unlike the prior art which uses a grid welded to the upper tubular crosspiece.

In this way, not only is it possible to choose when to use it and when not to, giving priority either to a firm resting of heavy loads on the grid or to visibility, but the grid 5 is also easily replaced in the case of damage.

The invention claimed is:

1. An apparatus (2) for a self-propelled operating machine (10) comprising a supporting frame (21, 22, 23) configured to be (A) fastened at the rear to an attaching device (101) coupled to an operating arm (102) of the machine (10), and (B) coupled at the front to a tool (3), wherein the supporting frame includes two lateral uprights (21, 22) joined adjacent the top by a transversal plate (23), wherein the transversal plate (23) has opposite upper and lower surfaces, the upper surface having a front edge and a back edge, the front edge being closer than the back edge to the front of the supporting frame (21, 22, 23); the apparatus (2) being configured and arranged so that (A) a first viewing area is provided above the upper surface of the transversal plate (23) and (B) a second viewing area is provided below the lower surface of the transversal plate (23), the first viewing area having a bottom, the bottom of the first viewing area being defined by the upper surface of the transversal plate (23), wherein a load-supporting grid (5) is removably attached to the upper surface of the transversal plate (23).

2. The apparatus (2) according to claim 1, wherein the transversal plate (23) is inclined downwards in the front direction.

3. The apparatus (2) according to claim 1, wherein the uprights (21, 22) are flat and parallel to each other and equipped with respective slots (211, 221) for receiving together an element (33) with an elongate shape for supporting the tool (3).

4. The apparatus (2) according to claim 1, comprising a central plate (25) connected to the transversal plate (23) and provided with a slot (251) for receiving an element (33) with an elongate shape for supporting the tool (3).

5. An accessory (1) for a self-propelled operating machine, comprising an apparatus (2) according to claim 1 and a tool (3) mounted in a removable fashion to the apparatus (2).

6. The accessory (1) according to claim 5, further comprising an element (33) which is elongate in shape and which supports the tool (3); wherein the accessory (1) includes at least one jaw (41, 42) which can be removably coupled to the element (33) for locking the tool (3) to a lateral upright (21, 22) of the apparatus (2).

7. The accessory according to claim 5, wherein the apparatus (2) is a fork-carrier and the tool (3) is a fork equipped with prongs (31, 32).

8. The accessory according to claim 7, wherein the transversal plate (23) lies in a plane which defines with a plane of the prongs (31, 32) an angle of between 20 and 30 degrees.

9. The accessory according to claim 8, wherein the angle is between 22 and 24 degrees.

10. The accessory according to claim 9, wherein the angle is substantially equal to 23 degrees.

11. The apparatus (2) according to claim 1, wherein the transversal plate (23) is a solid plate.

12. The apparatus (2) according to claim 1, wherein the load-supporting grid (5) comprises a plurality of vertically-extending slats, each slat defining a plane which is substantially parallel to a plane defined by one of said lateral uprights (21, 22).

13. The apparatus (2) according to claim 12, wherein the first viewing area is located between a pair of adjacent slats.

14. The apparatus (2) according to claim 1, wherein the apparatus (2) is configured and arranged so that a plurality of viewing areas, including the first viewing area, are provided above the upper surface of the transversal plate (23), each of the plurality of viewing areas having a bottom, each of the bottoms of the plurality of viewing areas being defined by the upper surface of the transversal plate (23).

15. The apparatus (2) according to claim 14, wherein the load-supporting grid (5) comprises a plurality of vertically-extending slats, each slat defining a plane which is substantially parallel to a plane defined by one of said lateral uprights (21, 22); wherein each of the plurality of viewing areas is located between a different pair of adjacent slats.

16. An accessory for a self-propelled operating machine, comprising:

a fork-carrier; and a fork equipped with prongs, said fork being removably mounted to the fork-carrier, wherein the fork-carrier comprises a supporting frame (21, 22, 23) configured to be (A) fastened at the rear to an attaching device (101) coupled to an operating arm (102) of the machine (10), and (B) coupled at the front to fork, wherein the supporting frame includes two lateral uprights (21, 22) joined adjacent the top by a transversal plate (23), wherein the transversal plate (23) has opposite upper and lower surfaces, the upper surface having a front edge and a back edge, the front edge being closer than the back edge to the front of the supporting frame (21, 22, 23), wherein the fork-carrier is configured and arranged so that (A) a first viewing area is provided above the upper surface of the transversal plate (23) and (B) a second viewing area is provided below the lower surface of the transversal plate (23), the first viewing area having a bottom, the bottom of the first viewing area being defined by the upper surface of the transversal plate (23), and wherein the transversal plate (23) lies in a plane which defines with a plane of the prongs (31, 32) an angle of between 20 and 30 degrees.

17. The accessory according to claim 16, wherein the angle is between 22 and 24 degrees.

18. The accessory according to claim 17, wherein the angle is substantially equal to 23 degrees.

* * * * *